US007953333B2

(12) United States Patent
Vanbortel et al.

(10) Patent No.: US 7,953,333 B2
(45) Date of Patent: May 31, 2011

(54) SYSTEM FOR MEASURING PRINT SHEET MOISTURE AND CONTROLLING A DECURLER IN A XEROGRAPHIC PRINTER

(75) Inventors: David P. Vanbortel, Victor, NY (US); Daniel H. Burnett, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 901 days.

(21) Appl. No.: 10/852,536

(22) Filed: May 24, 2004

(65) Prior Publication Data

US 2005/0260005 A1 Nov. 24, 2005

(51) Int. Cl.
*G03G 15/00* (2006.01)

(52) U.S. Cl. ..... 399/45; 399/406

(58) Field of Classification Search ..... 399/45, 399/406, 44, 389, 67

See application file for complete search history.

(56) References Cited

U.S. PATENT DOCUMENTS

| | | | | | |
|---|---|---|---|---|---|
| 3,841,892 | A * | 10/1974 | Krause et al. | 430/126 |
| 5,202,737 | A | 4/1993 | Hollar | 355/308 |
| 5,392,106 | A * | 2/1995 | Bigenwald et al. | 399/406 |
| 5,414,503 | A * | 5/1995 | Siegel et al. | 399/406 |
| 5,519,481 | A * | 5/1996 | Kuo | 399/406 |
| 5,831,744 | A * | 11/1998 | Kataoka | 358/296 |
| 5,887,220 | A | 3/1999 | Nagaoka | 399/46 |
| 5,933,698 | A | 8/1999 | Muramatsu | 399/406 |
| 5,943,526 | A * | 8/1999 | Kodama | 399/66 |
| 6,226,486 | B1 * | 5/2001 | Itou et al. | |
| 6,243,545 | B1 * | 6/2001 | Jewell | 399/67 |
| 6,246,860 | B1 * | 6/2001 | Ohmichi | 399/406 |
| 6,865,366 | B2 * | 3/2005 | Katayanagi et al. | 399/406 |

FOREIGN PATENT DOCUMENTS

| | | | |
|---|---|---|---|
| JP | 62058282 | A * | 3/1987 |
| JP | 02178165 | A * | 7/1990 |
| JP | 05323715 | A * | 12/1993 |
| JP | 05323798 | A * | 12/1993 |
| JP | 07248698 | A * | 9/1995 |
| JP | 08054797 | A * | 2/1996 |
| JP | 2004069910 | A * | 3/2004 |

OTHER PUBLICATIONS

English translation of Maeda et al. JP02-178165A.*

* cited by examiner

*Primary Examiner* — Quana M Grainger
(74) *Attorney, Agent, or Firm* — Ronald E. Prass, Jr.; Prass LLP

(57) ABSTRACT

In a xerographic printer, a transfer station is controlled to apply a constant current to the photoreceptor. A print sheet having a high moisture content will cause the control system to make a high voltage drain to maintain the constant current. A signal related to the voltage drain is used to control a decurler. The system enables the decurler to be controlled on a sheet-by-sheet basis.

8 Claims, 1 Drawing Sheet

SYSTEM FOR MEASURING PRINT SHEET MOISTURE AND CONTROLLING A DECURLER IN A XEROGRAPHIC PRINTER

TECHNICAL FIELD

The present disclosure relates to a system for decurling sheets in a xerographic printing apparatus.

BACKGROUND

In xerographic or electrostatographic printing, such as occurs in a copier or "laser printer," an image is created with marking material on a sheet, such as a sheet of paper or a transparency slide. At one point in the electrostatographic printing process, the sheet is typically heated, in a final fusing step, to permanently affix the marking material thereto.

As the sheet passes through the various processing stations in the printing apparatus, a curl or bend is frequently induced therein. This curl or bend may be inherent to the sheet material due to the method of manufacture thereof, or the curl can be induced by the interaction of a sheet with the processing stations within the printer. The curling of the sheet causes problems of handling as the sheet is processed within the printer, frequently producing jams or misfeeds within the printer. Even if the curl is induced only toward the end of the printing process, having curled output sheets is well known as a customer dissatisfier.

In many xerographic printers, a decurling station is provided downstream of the fuser. Typically a decurling station includes a relatively soft roll (or a flexible belt entrained around two or more rollers) urged against a relatively hard roll, forming a nip. When a sheet passes through the nip, any curl inherent in the sheet is in effect bent in the opposite direction, toward the hard roll, yielding a flat sheet. Typically, the pressure between the hard roll and the soft roll in the nip is adjustable, such as by the manual turning of a knob within the machine, or with a motor-driven mechanism.

PRIOR ART

U.S. Pat. No. 5,202,737 discloses a basic, manually-adjustable sheet decurler used in a xerographic printer.

U.S. Pat. No. 5,414,503 discloses a control system for affecting the extent of decurling in a xerographic printer. The inputs to a control system for the decurler are the weight of the copy sheet, the density of marking material in the transferred image, and the ambient humidity in the machine.

U.S. Pat. No. 5,887,220 discloses a control system for a xerographic printer in which various parameters, such as transfer voltage and fuser temperature, are controlled. A resistance associated with the transfer voltage is used to infer ambient conditions.

U.S. Pat. No. 5,933,698 discloses a control system for affecting the extent of decurling in a xerographic printer, using as an input the density of marking material in the transferred image.

SUMMARY

There is provided a method of operating an electrostatographic printing apparatus, the apparatus including a charge receptor, a transfer station forming a transfer zone associated with the charge receptor, and a controllable decurler for decurling a sheet downstream of the transfer station. A voltage resulting from controlling the transfer station is monitored, and the decurler is controlled based at least partly on the monitored voltage.

BRIEF DESCRIPTION OF THE DRAWINGS

The FIGURE is a simplified elevational view showing elements of a xerographic printing apparatus.

DETAILED DESCRIPTION

Figure 1:
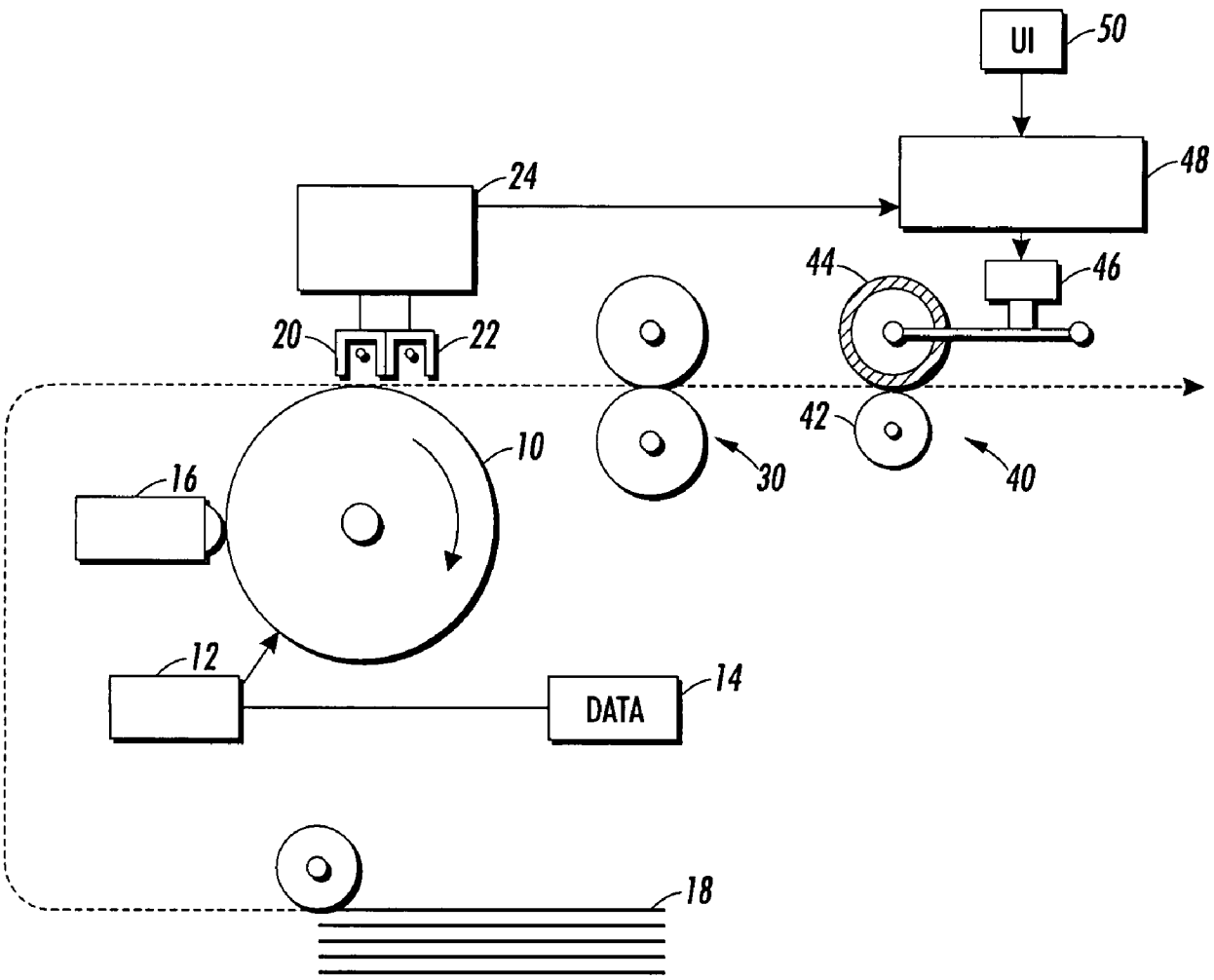

The FIGURE is a simplified elevational view showing elements of a electrostatographic printing apparatus, in this case a xerographic "laser printer." As is generally familiar, there is provided a rotating charge receptor in the form of photoreceptor 10. Portions of the outer surface of photoreceptor 10 are imagewise discharged by the action of a scanning laser 12, which is modulated according to digital image data, such as from driver 14. The image on photoreceptor 10 is then developed, at development unit 16, by application of toner or other marking material to appropriately-charged areas thereof. A sheet is drawn from a stack 18 and brought to a transfer zone including a transfer station 20, where the sheet receives the toner.

The transfer station 20 includes, in this embodiment, a corotron, which applies an electric charge to the sheet in the transfer zone to cause the toner on the photoreceptor 10 to attach to the sheet. Various types of corotron are known, and alternative transfer devices, such as a bias transfer roll, are familiar in the art. There may also be provided a detack corotron 22 to detach the sheet from the photoreceptor 10. Once a sheet, bearing toner forming an image, is detached from photoreceptor 10, the sheet is directed to a fuser 30, of any design known in the art. Broadly speaking, the action of the fuser tends to cause undesirable bending or curling of the sheet, typically bending away from the side of the sheet bearing the image. The curl induced in the sheet is a complex result of the differential drying due to energy applied to fuse the toner to the sheet, and the bending of paper and toner required to strip the sheet from the fuser roll surfaces. To "decurl" the sheet, there is provided a decurler 40 downstream of the fuser 30. Various general designs of a decurler are disclosed in the patents referenced above. Generally, a decurler 40 includes a hard roll 42 and a soft roll 44, urged against each other and forming a nip therebetween. When a sheet passes through the nip, the sheet is caused to wrap slightly around the hard roll 42, which bends the sheet back from the original curl direction, yielding a substantially flat sheet.

A controllable decurler is capable of reasonably fine adjustment in the extent of decurling it imparts to a sheet. The decurler should bend back the sheet just enough to flatten the sheet; too extensive decurling will result in a sheet curled in the opposite direction. In physical terms, the amount of bending-back is expressed as either an amount of pressure between the hard roll 42 and soft roll 44 (or an equivalent to a soft roll, such as a flexible belt) or as an amount of "penetration" of the soft roll 44 by the hard roll 42. In this embodiment, the nip pressure or penetration is established by a solenoid 46, although any number of pressure or penetration adjusting mechanisms, such as including screws, cams, etc. are familiar in the art. Solenoid 46 is in turn controlled to output a specific pressure or penetration by a control system 48, which will be described in detail below.

A control system 24 controlling the transfer station 20 is designed to cause transfer station 20 to apply a constant current toward the sheet and photoreceptor 10 during a transfer operation. A sheet with relatively high moisture content requires more energy to effect a transfer of toner thereto; if the control system 24 is designed to maintain a constant current in the transfer zone, the presence of a high-moisture-content sheet will cause a higher voltage drain by the transfer station 20 to maintain the constant current. At the same time, a sheet having a relatively high moisture content is more apt to experience curling when going through the fusing process; therefore, if it is known that a sheet has a high moisture content, it is advisable to increase the extent of decurling in the decurler 40, such as by increasing the nip pressure or penetration. In short, a high moisture content sheet will require both a higher voltage drain at transfer, and a greater extent of decurling at the decurler 40.

As shown in the FIGURE, the control system 24 controlling the transfer station 20 informs the control system 48 controlling the decurler 40. (Either control system 24, 48 can of course be part of a larger, more general control system for the whole apparatus, but each is shown distinctly here for clarity.) In effect, a signal from control system 24 representative of the voltage drain for a particular sheet in the transfer zone is sent to the control system 48: a signal representative of a high voltage drain would be taken by control system 48 to mandate a relatively high extent of decurling, i.e., a high pressure or penetration between rolls 42 and 44. Thus, when a high moisture content is in effect detected by transfer station 20, the appropriate decurling extent for that particular sheet is provided by the decurler 40 by the time the sheet reaches the decurler 40. The system can thus make adjustments in decurling extent on a real-time, sheet-by-sheet basis, taking into account of course a time lag for a sheet or a portion of a sheet, moving between the transfer station 20 and the decurler 40.

With the present disclosure, the moisture content of the sheet is directly measured, and not merely inferred from the ambient humidity. In some of the above references, the ambient humidity around a machine is measured, such as through a humidity meter, and the measurement is used in a control system for the decurler. With the ambient-humidity system, adjustments to the decurler cannot be made on a sheet-by-sheet, or even on a relatively short-term, basis. Also, there may not be a reliable correlation between ambient humidity and the moisture content of a sheet at a particular time: if the printing apparatus has multiple, switchable paper supply stacks (which may include supplies of transparencies or other plastic-based stocks), or if a new supply of paper is loaded, there may be a major change in moisture content between one sheet and the immediately subsequent sheet, and this sudden change would not be evident from the measured ambient humidity.

Depending on the precision of the overall system or any portion thereof, the response of control system 48 to a signal from control system 24 can be highly linearized, or have a few discrete levels of matching an appropriate decurling extent to a measured moisture content. A binary system could simply mandate a fixed extra amount of decurling only if the measured moisture content or voltage drain at the transfer station 20 exceeds a predetermined threshold. A more sophisticated system could recognize a pattern or profile of changes in voltage drain (such as at the lead edge, middle, and trail edge) in the course of transferring an image to a sheet, and adjust the behavior of the decurler 40 accordingly. The system can facilitate a method whereby the extent of decurling can be adjusted within the processing of a single sheet, which may be useful if a sheet has both low-coverage areas such as text and high-coverage areas such as a dark photograph.

In addition to the measured moisture content of each sheet, other inputs may be made to a control system 48 governing a decurler 40: for example, a characteristic of a sheet being fed at given time, e.g., its weight, coating, etc., can be entered through a user interface 50 and recalled when that stock is being drawn. Another relevant type of input data is the amount of toner or other marking material is on the sheet; this data can be derived by a pixel count or equivalent from the data from driver 14 controlling the modulating laser for a particular sheet. All of these inputs can be entered into an algorithm for controlling decurler 40.

Although a simple, monochrome xerographic printer is shown in the FIGURE, the present discussion is equally applicable when taking into account, for instance, a printer capable of two-sided printing, such as with a duplex loop. The discussion is also valid for printers (such as color printers) having multiple photoreceptors contributing toner to a single intermediate transfer belt: in such a case, the intermediate transfer belt is the charge receptor, and the transfer station is where the intermediate transfer belt transfers accumulated toner to the print sheet.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A method of operating an electrostatographic printing apparatus, the apparatus including a charge receptor, a transfer station forming a transfer zone associated with the charge receptor, and a controllable decurler for decurling a sheet downstream of the transfer station, comprising:

controlling the transfer station to obtain a substantially constant current in the transfer zone;

monitoring a voltage resulting from controlling the transfer station; and controlling the decurler based at least partly on the monitored voltage.

2. The method of claim 1, wherein the decurler is controlled substantially in real time.

3. The method of claim 1, wherein the decurler is controllable to alter an extent of decurling during decurling of a single sheet.

4. The method of claim 1, the transfer station including a corotron.

5. The method of claim 1, the charge receptor being a photoreceptor.

6. The method of claim 1, further comprising monitoring an amount of marking material placed on a sheet; and controlling the decurler based at least partly on the monitored amount of marking material.

7. The method of claim 1, further comprising controlling the decurler based at least partly on a characteristic of the sheet.

8. The method of claim 1, the decurler including a first roll and a second roll, and controlling decurling by altering a pressure of the first roll against the second roll.

* * * * *